US005651148A

United States Patent [19]

Bayot

[11] Patent Number: 5,651,148

[45] Date of Patent: Jul. 29, 1997

[54] TOILET WITH VORTEX FLUSHING ACTION

[75] Inventor: Antonio G. Bayot, Newtown, Pa.

[73] Assignee: American Standard, Piscataway, N.J.

[21] Appl. No.: 473,642

[22] Filed: Jun. 7, 1995

[51] Int. Cl.[6] ..... E03D 11/02

[52] U.S. Cl. ..... 4/421

[58] Field of Search ..... 4/420–421, 429

[56] References Cited

U.S. PATENT DOCUMENTS

| | | | |
|---|---|---|---|
| 1,626,155 | 4/1927 | Rekewitz . | |
| 1,711,295 | 4/1929 | Wernle . | |
| 1,822,378 | 9/1931 | Schossow | 4/421 |
| 1,966,786 | 7/1934 | Brain | 4/421 |
| 3,538,518 | 11/1970 | Helke et al. | 4/420 X |
| 4,404,696 | 9/1983 | Heinze et al. | 4/420 |
| 4,930,167 | 6/1990 | Ament | 4/420 |
| 4,987,616 | 1/1991 | Ament | 4/421 |
| 5,218,726 | 6/1993 | Jaeckels et al. | 4/420 |
| 5,283,913 | 2/1994 | Jaeckels | 4/420 |

FOREIGN PATENT DOCUMENTS

| | | | |
|---|---|---|---|
| 6185102 | 7/1994 | Japan | 4/421 |
| 0685960 | 1/1953 | United Kingdom | 4/421 |

*Primary Examiner*—Charles E. Phillips

*Attorney, Agent, or Firm*—Elaine Brenner Robinson; Ann M. Knab

[57] ABSTRACT

A toilet bowl and rim construction capable of generating superior vortex flushing action. A rim restrictor means is strategically positioned on a side of the rim to direct the bifurcated streams of water to converge at the side of the rim. The relocation of the contact point from the conventionally placed central position to a strategically located side position increases the velocity and force on the water stream. Control of the volume, flow rate and directional orientation of the flushing water into and within the rim cavity and through rim discharge orifices produces superior vortex flushing action.

3 Claims, 4 Drawing Sheets

TOILET WITH VORTEX FLUSHING ACTION

BACKGROUND OF THE INVENTION

The present invention is directed to a toilet, and more particularly to a water control mechanism for directing water flowing through the rim of the toilet bowl.

In the past, conventional flushing mechanisms used in toilet flushing operations generally used one of two different approaches to remove waste material from the toilet bowl. In the first approach, siphoning action was utilized to create a vacuum which drew bowl water and waste water into the drain line and refilled the bowl with fresh water. In a second approach which was typically used in household applications, a tank on the toilet bowl held a predetermined amount of water which, when released, generated a high velocity flow which carried bowl water and waste into the drain line and refilled the bowl with fresh water. The second approach relied on the weight of the water due to gravity to flush and replenish the bowl. Since the weight of the water alone was utilized to flush and replenish the bowl, conventional toilets using this conventional system required about 3 to 5 gallons per flush (GPF).

In response to the increasing concern to conserve water, legislation was enacted requiring reduced water consumption in the flushing of toilets. As of Jan. 1, 1994, toilets must consume less than or equal to 1.6 GPF. As a result, the construction of toilets has changed to compensate for the low water consumption requirements. Changes in construction have included modifications in the design of the trapway, tank, bowl and flushing valves.

The basic function of a water closet is to dispose of waste material utilizing a water flush action. Flushing efficiency is dependent on the volume and flow rate of the water introduced into the bowl and the water discharge means defined by the bowl rim. In conventional toilets, the toilet rim is hollow and generally of uniform cross-sectional shape. When the toilet is flushed, water will flow through the rim and exit through small holes on the underside of the rim to wash the sides of the bowl during flushing. This flow also acts to assist in creating an appropriate siphon action in certain toilets. Typically, the water enters the rim on each side, traveling both in clockwise and counterclockwise directions. The bifurcated water streams traveling within the opposite sides of the rim cavity meet at the front of the bowl, whereat the water is downwardly discharged onto the front wall surface of the toilet bowl through discharge orifices which are located on the underside of the rim. Typical rim discharge orifices include holes, slots, and a combination thereof, which can be aligned perpendicular to the underside surface of the rim or oriented angularly toward the bowl.

The prior art discloses various shaped orifices in toilet bowl rims. More specifically the prior art has shown the use of raised plateaus and well-like sections formed in the rim floor adjacent the front of the bowl. These modifications in the rim at the front section of the rim direct the bifurcated water streams to exit directly at the central front portion of the bowl. Vortex action is thus not created and the bulk flushing performance is weak.

It is desirable to control the flow of the water in the rim such that the bifurcated water streams meet at a point on a side of the rim. It is important that vortex action is created to provide improved siphonic action during the flushing cycle.

SUMMARY OF THE INVENTION

It is an object of the invention to direct the flow of water in the rim to increase the flushing performance of the toilet.

It is another object to maximize the effectiveness of the flushing water.

It is a related object to generate vortex flushing action to increase bulk flushing performance.

These and other objects and advantages are achieved by the present invention which provides a toilet bowl and rim construction capable of generating superior vortex flushing action. A rim restrictor means is strategically positioned on a side of the rim to direct the bifurcated streams of water to converge at the side of the rim. The relocation of the contact point from the conventionally placed central position to a strategically located side position increases the velocity and force on the water stream. Control of the volume, flow rate and directional orientation of the flushing water into and within the rim cavity and through rim discharge orifices produces superior vortex flushing action.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
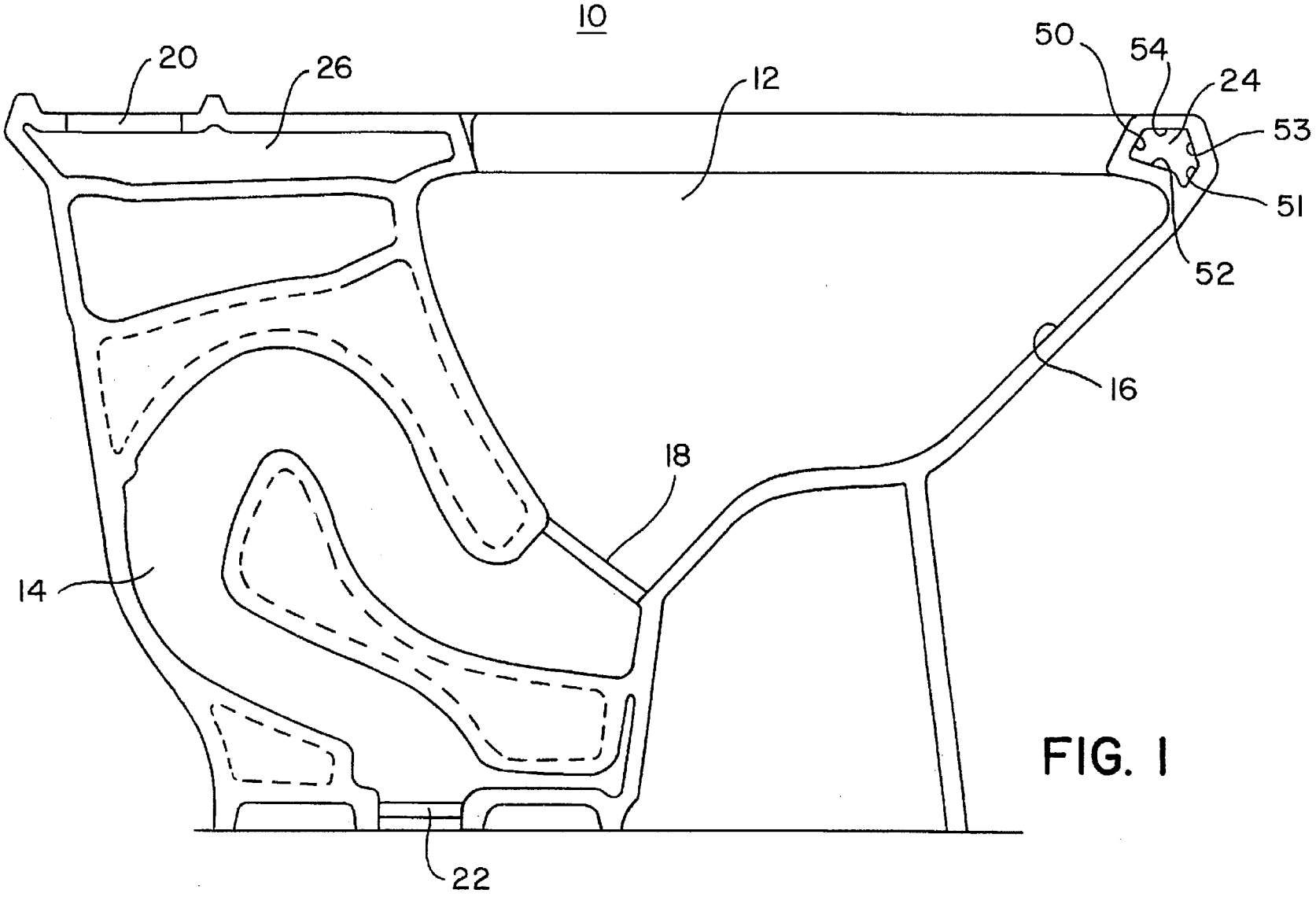
FIG. 1 is a side view of a toilet in accordance with the present invention.

Reference is now made to the figures which depict toilet 10 having a bowl 12 and a trapway 14. Bowl 12 includes front wall 16 which converges downwardly to an outlet 18. Bowl 12 is substantially funnel shaped for rapidly centering waste adjacent to outlet 18. Toilet 10 includes inlet 20 for receiving water from a tank (not shown). Trapway 14 carries water and waste from bowl 12 to discharge opening 22 which is connected to a drain line (not shown).

Bowl 12 is upwardly open, the top edge of which includes a hollow rim 24 which extends the periphery of the top of bowl 12. Rim 24 is connected to receiving chamber 26 which receives water from a tank via inlet 20. As shown in FIG. 1, the cross-section of the rim is generally trapezoidal having substantially uneven parallel side walls 50 and 51, slightly angled bottom floor 52, angled side wall 53 and substantially horizontal top side or ceiling 54.

Figure 2:
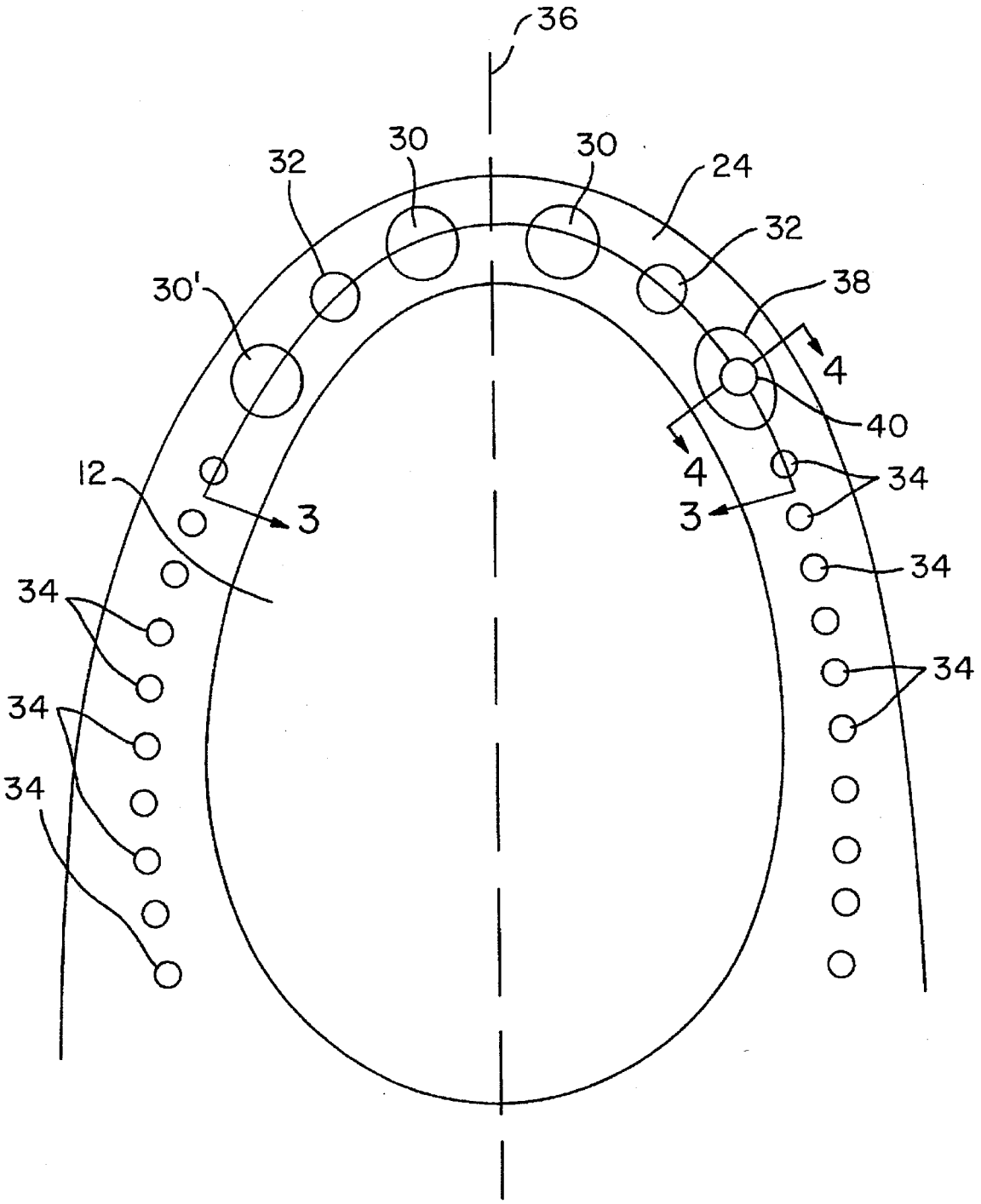
FIG. 2 is a top plan view of a portion of the toilet shown in FIG. 1.

Reference is made to FIG. 2 which shows a top plan view of bowl 12 and hollow rim 24 of the present invention. Rim 24 includes a series of rim orifices or holes 30, 32 and 34 which vary in size positioned along the periphery of the rim floor 52. Bottom floor 52 is angled downwardly from inner to outer side so that water exiting the holes flows down the inner surface of bowl 12. Holes 30 (and 30'), 32 and 34 are, respectively, approximately ¾ inch, ⅝ inch and 7/32 inch in diameter. As shown in FIG. 2, two holes 30 are located proximate to the center point or axis 36 with the third hole 30' positioned on the left side of rim 24, two slots from central axis 36.

Figure 3:
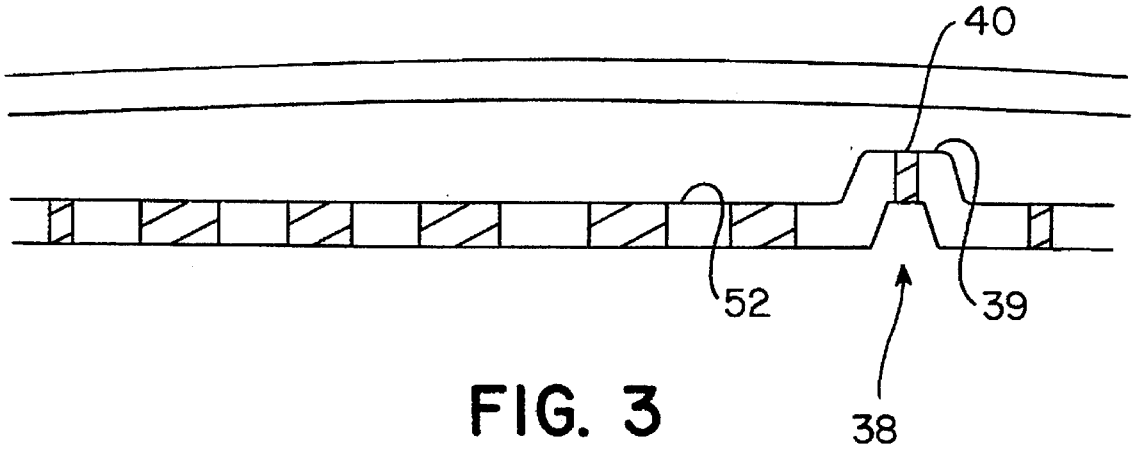
FIG. 3 is a partial sectional view taken along line 3—3 of FIG. 2.
Figure 4:
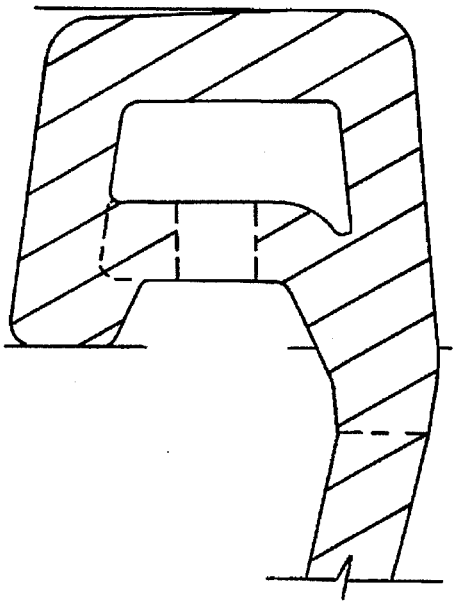
FIG. 4 is cross-sectional view taken along line 4—4 of FIG. 2.

On the right side, symmetric to the position of hole 30' located on the left side, is disposed a water flow resistor or rim restrictor means 38. FIGS. 3 and 4 depict rim restrictor means 38 as having an elevated bottom floor 39 in comparison to rim floor 52. Restrictor means 38 is formed in rim 24 whereat floor 52 extends upward vertically to a point, continues horizontally a short distance and then extends downward vertically to the normal level of the rim floor and continues at the normal level as rim floor 52. Rim restrictor means 38 may or may not include a rim hole 40 therein which, if present, is approximately ⅜ inch in diameter. The locations of the rim holes in combination with the rim restrictor means provide a vortex-like swirling movement when water is passed through rim 24 out rim holes 30, 32 and 34.

In conventional toilets, water typically flows through the rim in both counter clockwise and clockwise directions. As water flows from the tank to the receiving chamber in a toilet, it propels forward moving as a bifurcated stream in two directions in the rim cavity and flows around to the center front point of the rim cavity whereat both streams meet. Up to this point, the water is moving at a high velocity to the center front of the rim and very little exits through the rim holes. When the streams reach the center point, water begins to exit the rim holes proximate the center point of the rim.

Figure 5:
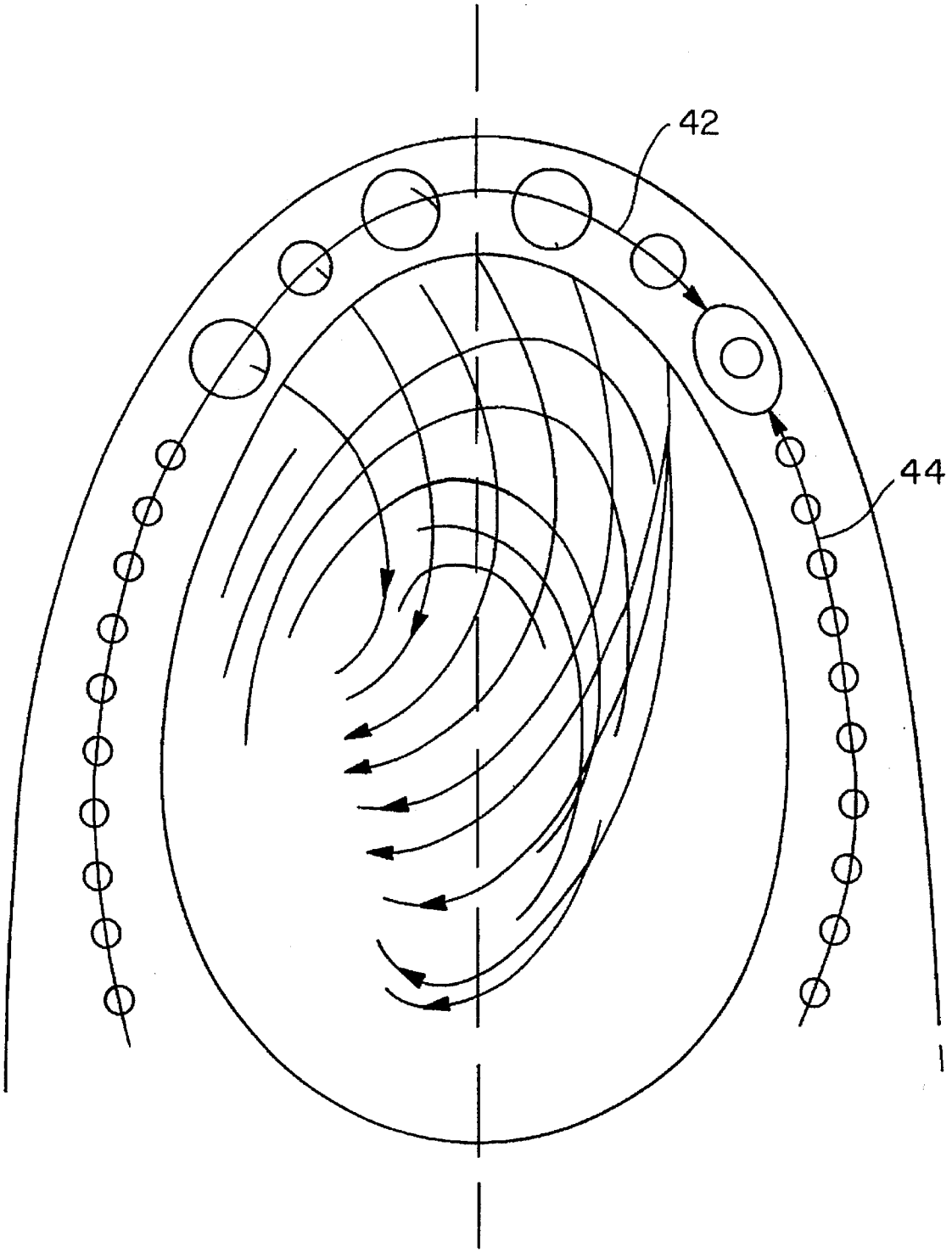
FIG. 5 is a schematic representation of the vortex created by water within the rim cavity as it discharges into the bowl.

In the rim construction of the present invention, water strikes chamber 26 and is propelled forcefully forward into rim 24. The water travels in both the clockwise 42 and counter clockwise 44 directions. During this stage of the cycle, water passes with great speed toward the front of the rim. Reference is made to FIG. 5 which shows the movement of the water. Unlike conventional toilet rims wherein the water streams meet at the most central point, the rim of the present invention is designed such that the two streams of water meet at a point on the side of rim 24. In this example, the flow of the water streams is interrupted at the point on the right side of the rim whereat restrictor means 38 is located. It should be mentioned that the rim restrictor means may instead be positioned on the left side of the rim cavity and the same effects will result.

The clockwise direction 42 of the water streams accounts for approximately 200 of travel within the rim. Rim restrictor means 38 is substantially vertical as shown in FIG. 3. When the water streams contact rim restrictor means 38, the velocity decreases and the water stops abruptly. Water begins to exit rim holes 30 and 32 located to the left of rim restrictor means 38. As the water exits the rim holes, it is angularly discharged into the bowl traveling in a swirl-like or vortex profile. Subsequently, water exits holes 34 positioned along the sides and rear of rim 24.

The positioning of rim restrictor means 38 on the side of rim 24 serves to control the volume, flow rate and directional orientation of the water flowing through the rim. Water stream 42 traveling in the clockwise direction travels a further distance than water stream 44 which travels in the counter clockwise direction. Thus, water stream 44 is able to develop momentum and increase the flow rate. This results in an increase in water velocity which produces a stronger swirling or vortex action as water is discharged through holes 30 and 32.

Although illustrative embodiments of the present invention have been described herein with reference to the accompanying drawings, it is to be understood that the invention is not limited to those precise embodiments and that various other changes and modifications may be effected therein by one skilled in the art without departing from the scope or spirit of the invention.

What is claimed is:

1. A toilet comprising:

a bowl having a basin and an upper hollow rim disposed around the periphery of the basin, said rim including a ceiling and a floor, said rim having a forward side and a rearward side;

a trapway connected to said bowl;

a water flow restrictor disposed in said forward side of said rim, said water flow restrictor having an elevated floor formed in said rim floor; said rim includes a plurality of rim holes of varying sizes positioned around the periphery of the rim, said rim holes include ¾ inch diameter holes, ⅝ inch diameter holes and 7/32 inch diameter holes wherein said ¾ inch diameter holes are positioned proximate to each side of a central axis of said rim, passing from said forward side to said rearward side, and said ⅝ inch diameter holes are positioned proximate each ¾ inch diameter hole opposite the side of said central axis, said water flow restrictor positioned proximate to one of said ⅝ inch diameter holes opposite the side of the ¾ inch diameter holes, said water flow restrictor including a single hole therein, said rim having only one water flow restrictor therein.

2. The toilet of claim 1 wherein hole in said rim restrictor means ⅜ inch in diameter.

3. The toilet of claim 1 wherein said rim restrictor means is elevated at a height approximately one-half a distance between said rim floor and said rim ceiling.

* * * * *